United States Patent [19]

Kibler et al.

[11] 4,015,658

[45] Apr. 5, 1977

[54] APPARATUS FOR ELECTRIC ENHANCEMENT OF HEAT TRANSFER

[75] Inventors: Kenneth G. Kibler; Harris G. Carter, Jr., both of Fort Worth, Tex.

[73] Assignee: The United States of America as represented by the Secretary of the Air Force, Washington, D.C.

[22] Filed: Nov. 12, 1975

[21] Appl. No.: 631,355

[52] U.S. Cl. ..... 165/96; 165/1; 313/146; 313/336

[51] Int. Cl.[2] ..... F28F 13/16

[58] Field of Search ..... 165/1, 96; 313/146, 313/336; 315/111.9

[56] References Cited

UNITED STATES PATENTS

| | | | |
|---|---|---|---|
| 3,361,337 | 1/1968 | Hurst | 315/111.9 |
| 3,938,345 | 2/1976 | Yamaga et al. | 165/1 X |

*Primary Examiner*—Alan Cohan
*Assistant Examiner*—Gerald A. Michalsky
*Attorney, Agent, or Firm*—Joseph E. Rusz; George Fine

[57] ABSTRACT

An apparatus is provided for increasing heat transfer from an object at a temperature above ambient by directing a localized corona discharge toward the heated object.

4 Claims, 2 Drawing Figures

APPARATUS FOR ELECTRIC ENHANCEMENT OF HEAT TRANSFER

STATEMENT OF GOVERNMENT INTEREST

The invention described herein may be manufactured and used by or for the Government for governmental purposes without the payment of any royalty thereon.

BACKGROUND OF THE INVENTION

The invention relates generally to an apparatus for lowering the temperature of a heated object in air or any other gas. More particularly, the invention relates to an apparatus for increasing heat transfer from an object at a temperature above ambient by directing a localized corona discharge toward the heated object. Even more particularly, the invention relates to an apparatus for increasing heat transfer from an object at above ambient temperature by applying a voltage (+DC or AC) of about 5000 volts between a needle and a small conducting screen near the needle point and placing this assembly near the heated object in air or any other gas. If the object of interest is initially at a temperature lower than ambient, the present apparatus may be used to raise the object temperature to ambient.

Heretofore and up to the present time, other methods utilizing an electric field have been evolved for this purpose. The nearest approach to the present apparatus utilizes pointed probes charged to very high voltages (15–60 kilovolts) and directed toward heated samples which are electrically grounded. Such high voltage probes must be located at least several centimeters from the heated objects to prevent spark discharge. The possible disadvantages of these methods are that the high voltages required may constitute a safety hazard, the high voltages required may be beyond the normal output range of readily available high voltage supplies, and adequate electrical grounding of the heated sample is often difficult or impractical, particularly if the sample is electrically nonconducting. In addition, these previous methods do not localize the electric field, and a high field gradient exists at the surface of the heated object.

It is shown that the mechanism for cooling by these methods is a phenomenon usually known as the electric, or corona, wind. A nonuniform electric field, such as produced by a charge needle and grounded plane, generates air motion away from the charged point by several electric forces. The significant feature of the effect is that all physical phenomena responsible for the wind occur within usually a millimeter of the charged point. It is therefore not necessary to impose a very high voltage across an air gap of typically centimeters. Rather, the charged probe can be miniaturized, i.e., made physically smaller, operated at considerably lower voltage, placed in close proximity to the heated sample if desirable, and electrically screened to largely shield the heated object and its environment from the electric field.

The referred to miniaturization requires that the electric field be concentrated along the axis of the probe and in the direction of the object to be cooled. An essential feature of the design disclosed herein is that the proper field distribution is obtained by using a grounded screen which subtends a relatively small angle at the probe tip and which is rigidly supported on the probe axis by a thin cylindrical housing of nonconducting material provided with slots to allow the entrainment of air or other cooling gases. The construction provides for a concentrated directional cooling, that is, the structure is designed to concentrate the amperage or electric current flow in the desired direction, e.g., toward the sample being cooled. Heretofore the direction of current flow has usually been dispersed outward from a probe type over a wide angle. Since under the theory of ionic drag the airflow moves in the direction of current flow the airflow has not been concentrated. With the present invention the sides of the probe are an insulator in the form of a tube, in this case cylindrical and longitudinally slotted, and the screen small. Thus, the current flowing from the probe to the screen is concentrated in the direction of the screen and air currents resulting from ionic drag flowing from the screen to the sample are directionally concentrated toward the sample. If the screen were greatly enlarged or if the probe had screen all around or if no screen is used, air movement is more dispersed and is not the concentrated directional airflow provided by this invention.

It is noted that in the prior art, 15 to 60 kilovolts were required for usable cooling. In this invention, typically 5 kilovolts are needed although higher voltage can be used including those of the prior art. The advantages are smaller, more compact, less expensive power supply and interconnecting cables; less chance for dielectric breakdown (insulation failure), and thus safer to personnel.

Another prior art limitation is the necessity of electrically grounding the sample to be cooled, whereas in the present apparatus the sample need not be grounded. Thus for small, fragile, expensive samples, particularly ones which are not good conductors, it may be difficult to properly ground the sample if the previous method is used. In the present apparatus, nothing need be physically attached or be in contact with the sample. The chance of disturbing a delicate alignment, scratching a sample, or changing its inherent characteristics is thus alleviated.

Another limitation in the prior art arises from the typical utilization of 15 – 60 kilovolts. The probe sample spacing is typically several centimeters. In the present invention, the probe may be located almost arbitrarily near the sample permitting compact design, particularly for confined regions with limited available space.

Yet another limitation in the prior art was the existence of a high electric field at the sample surface. In the present apparatus, the electric field is excluded from the sample. This reduces the possibility of damage to the sample, particularly in the case of an inadvertent spark discharge from the high voltage needle. In the present case, the discharge terminates on the screen, and the sample is protected.

SUMMARY OF THE INVENTION

An apparatus for electric enhancement of heat transfer is provided. The apparatus increases heat transfer from an object at a temperature above ambient by directing a localized corona discharge toward the heated object. The apparatus comprises a probe assembly including a hollow insulating cylinder enclosing a solid insulating rod which is conically shaped at one end. The insulating cylinder encloses a needle point which is connected to a high voltage supply by a wire running along the axis of the solid insulating rod. A grounded conducting screen is attached to the hollow insulating cylinder at the end with the needle. The insulating cylinder is slotted with openings to permit free motion of air or other gaseous medium. In operation, an object at above ambient temperature is placed near the grounded screen of the probe. A high voltage is applied between the needle and the grounded screen. The corona discharge between the needle and the grounded screen creates an ionic wind for providing concentrated directional cooling.

DETAILED DESCRIPTION OF THE PREFERRED EMBODIMENT

Figure 1:
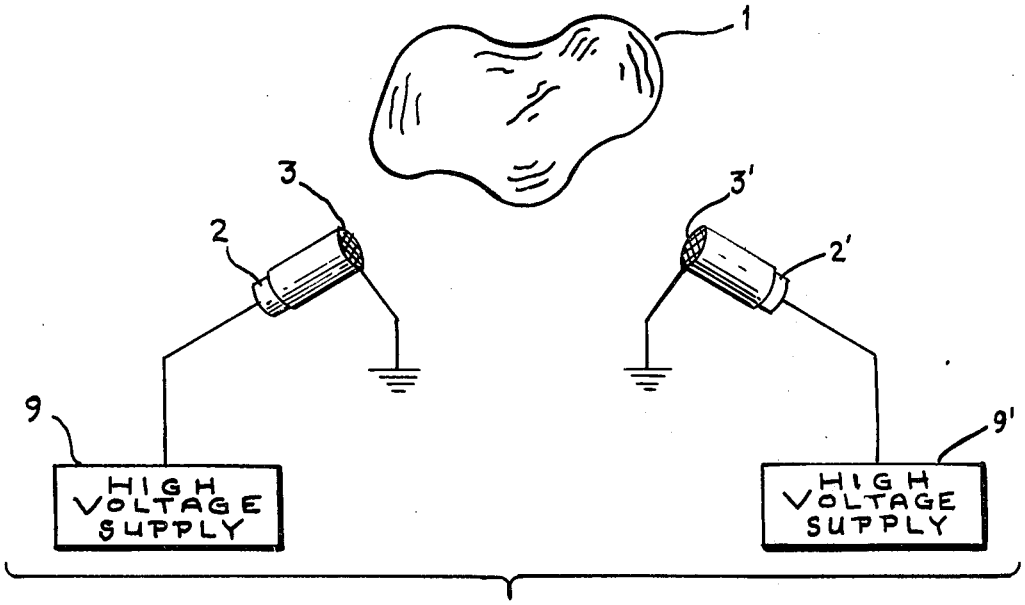
FIG. 1 diagrammatically illustrates apparatus for lowering the temperature of a heated object.

Referring to FIG. 1, the heated object 1 is near one or more screened probe assemblies 2 and 2', each of which has an electrically grounded conducting screen 3 and 3' on the end of the probe assemblies 2 and 2', respectively, which is nearest the heated object. There is also shown voltage supplies 9 and 9'. The probe assemblies are shown in more detail in FIG. 2.

Figure 2:
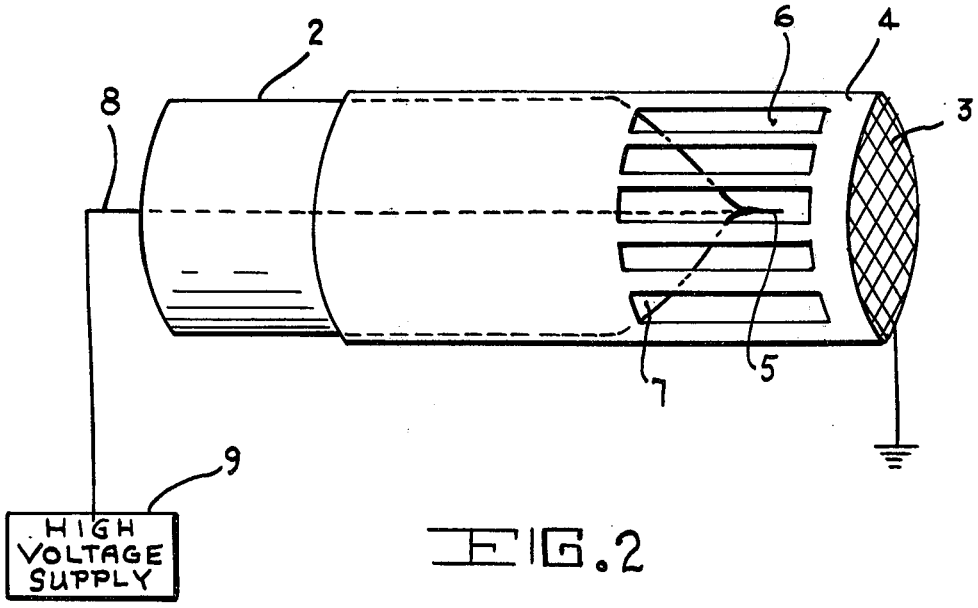
FIG. 2 diagrammatically illustrates the cooling apparatus.

In FIG. 2, grounded conducting screen 3 is attached to hollow insulating cylinder 4. This insulating cylinder 4 encloses conducting needle point 5 which is connected to high voltage supply 9 by wire 8 along the axis of solid insulating rod 7 which is conically shaped near electrically conducting needle 5 and rigidly holds needle 5 on the axis of the probe assembly. Insulating tube 4 is slotted with openings 6 to permit free motion of air or whatever gaseous medium is employed, and slides over insulating rod 7 so that the spacing between needle 5 and screen 3 may be adjusted. It is noted that tube 4 is slightly pressure fitted to rod 7 permitting this adjustment.

An example of the working parameters for this assembly would be a potential of about 5000 volts applied to the needle, a screen diameter of 1 cm, and a needle to screen distance of 0.5 cm. These, of course, may be varied as necessary. A useful parameter for comparing the cooling capability for a given probe configuration with other such configurations is the corona current measured between the charged needle and the grounded screen. Since our research has shown that the cooling rate is proportional to the fourth root of total corona current ($[i]^{1/4}$), then the voltage and probe/screen spacing may be varied in a manner which keeps the current, and thus the cooling rate, essentially constant. This adds flexibility in varying the probe/screen design without attendant penalties such as decreased cooling rate. It is thus recognized that the needle-to-screen spacing and the voltage applied to the needle may be varied in a manner which keeps the current essentially constant. It is also recognized that the shape of the screen and insulator assembly may be varied to optimize the mutual capacitance of the system and the wind flow for specific applications without departing from the spirit and scope of the invention herein described.

As thus described, the cooling technique is characterised by the use of a localized nonuniform electric field to increase the heat transfer from an object at some temperature above ambient, the heated object being located in air or any other gas. It is also characterized by a compact configuration of charged needles and grounded screens which exclude the electric field from the heated sample by providing localization of the electric field essentially to the small volume of space between the screen and needle, and a power supply and cables to provide high voltage (±DC or AC) of several thousand volts magnitude between the needles and associated screens, said power supply being preferably metered to register applied voltage and current values.

The apparatus as here described will thus lower the temperature of an object initially above ambient, and raise the temperature of an object initially below ambient temperature.

What is claimed is:

1. Apparatus for electric enhancement of heat transfer of a heated object excluding the electric field therefrom in a preselected gaseous medium comprising a solid insulating rod of a predetermine diameter conically shaped at one end thereof, an electrically conducting point rigidly affixed to said conically shaped end and extending therefrom, an external high voltage supply of a predetermined magnitude, an electrical conductor running along the longitudinal axis of said solid insulating rod interconnecting said external high voltage supply and said electrically conducting point, a grounded conductive screen, a hollow insulating tube of a predetermined diameter having first and second openings, said grounded conductive screen completely covering said first opening, said hollow insulating tube being cylindrically and longitudinally slotted in the approximate region of said first opening, permitting free motion of said preselected gaseous medium, said hollow insulating tube enclosing said solid insulating rod and slightly pressure fitted thereto permitting sliding over said solid insulating rod for adjustment of the spacing of said electrically conducting point and said grounded conductive screen, the combination of said solid insulating rod, said electrically conducting point, said high voltage supply, said hollow insulating tube, and said grounded conductive screen constituting a first probe, the grounded conductive screen of said first probe being placed in the immediate region of said heated object to permit concentration of electric current flow toward the heated object.

2. Apparatus for electric enhancement as described in claim 1 wherein said high voltage supply being in the region of 5000 volts, said grounded conductive screen being 1 cm in diameter, and said electrically conducting point being spaced from said grounded conductive screen a distance of 0.5 cm.

3. Apparatus for electric enhancement of heat transfer as described in claim 1 further including a second probe identical to said first probe also positioned in the immediate region of said heated object.

4. Apparatus for electric enhancement as described in claim 3 wherein in each of said first and second probes, said high voltage supply being in the magnitude of 5000 volts, said grounded conductive screen having a 1 cm diameter, and said spacing between said electrically conducting point and said grounded conductive screen being 0.5 cm.

* * * * *